US006523777B2

(12) United States Patent
Gaudio

(10) Patent No.: US 6,523,777 B2
(45) Date of Patent: Feb. 25, 2003

(54) PORTABLE WIRE SPOOL CADDY

(76) Inventor: Michael F. Gaudio, 208 N. Dee Rd., Park Ridge, IL (US) 60068

( * ) Notice: Subject to any disclaimer, the term of this patent is extended or adjusted under 35 U.S.C. 154(b) by 0 days.

(21) Appl. No.: 09/900,929

(22) Filed: Jul. 9, 2001

(65) Prior Publication Data

US 2003/0006335 A1 Jan. 9, 2003

(51) Int. Cl.[7] ..... B65H 49/24; B65H 49/32
(52) U.S. Cl. ..... 242/595.1; 242/594.1
(58) Field of Search ..... 242/594.2, 595.1, 242/594.1, 129.5, 595, 588

(56) References Cited

U.S. PATENT DOCUMENTS

| | | | | |
|---|---|---|---|---|
| 2,721,710 A | * | 10/1955 | Birchler et al. | 242/594.2 |
| 4,066,220 A | * | 1/1978 | Beck et al. | 242/595.1 |
| 4,211,374 A | * | 7/1980 | Salviso | 242/595.1 |
| 4,497,453 A | | 2/1985 | Butcher | |
| 4,936,079 A | | 6/1990 | Skalsky et al. | |
| 5,495,653 A | | 3/1996 | Schrock et al. | |
| 5,634,610 A | * | 6/1997 | Walsh | 242/594.2 |
| 5,657,945 A | | 8/1997 | Bryant | |
| 5,687,928 A | * | 11/1997 | Lassiter | 242/594.1 |
| 5,829,710 A | | 11/1998 | Halle et al. | |
| 5,944,280 A | | 8/1999 | Dimitri | |
| 5,967,451 A | * | 10/1999 | Radaios | 242/594.2 |

FOREIGN PATENT DOCUMENTS

| | | | |
|---|---|---|---|
| DE | 39 02 268 A1 | 8/1990 | |
| IT | 556076 B | 2/1957 | |
| JP | 4-323168 A | 11/1992 | |
| JP | 5-43130 * | 5/1993 | 242/594.2 |

* cited by examiner

*Primary Examiner*—John M. Jillions
(74) *Attorney, Agent, or Firm*—Henry C. Query, Jr.

(57) ABSTRACT

The present invention is directed to a wire spool caddy for releasably holding at least one cylindrical spool having an outer diameter while a wire or the like is being unwound from the spool, the caddy comprising an elongated frame which includes first and second spaced apart ends; a plurality of generally parallel fixed rods which each extend between and are connected to the first and second ends; and at least one movable rod which is generally parallel to the fixed rods and which extends between and is pivotably connected to the first and second ends; wherein at least two of the fixed rods are separated by a first distance which is less than the diameter of the spool to thereby form a bottom support for the spool; and wherein the movable rod is pivotable between a first position in which the movable rod is separated from an adjacent fixed rod by a second distance that is less than the diameter of the spool, and a second position in which the movable rod is separated from the adjacent fixed rod by a third distance which is greater than the diameter of the spool; whereby when the movable rod is in its first position the spool is retained between the movable rod and the fixed rods, and when the movable rod is in its second position the spool may be removed or inserted between the movable rod and the adjacent fixed rod.

18 Claims, 5 Drawing Sheets

PORTABLE WIRE SPOOL CADDY

BACKGROUND OF THE INVENTION

The present invention relates to a device for holding and transporting one or more spools of wire. More particularly, the invention relates to such a device which comprises a plurality of rods for retaining the spools firmly within the caddy as the wire is being pulled therefrom and a pivot arm assembly for allowing one of the rods to be manually displaced so that the spools can be quickly and easily removed and replaced.

In certain prior art wire spool caddies, the spool is rotatably supported on an elongated rod which extends through an axial hole in the spool and is secured to a supporting frame. However, this arrangement requires that the rod be detached from the frame and withdrawn from the axial hole in order to remove and replace an empty spool. While this is not a great problem for single-spool caddies, removing a single spool from a multiple-spool caddy can be quite cumbersome since the rod must be detached from the frame and withdrawn from the axial holes of all of the spools before the single spool can be removed. In addition, as the wire is being pulled from the spool, the spool tends to freewheel on the rod, which forces the wire to unwind faster than it can be pulled by the user. This can result in the wire becoming tangled over the rod, a situation that requires the user to waste potentially valuable time untangling the wire before it can again be pulled.

The prior art has attempted to address some of these problems by providing wire spool caddies which do not utilize a rod to support the spool through its axial hole. Instead, these caddies comprise a framework of bars and/or sheet material which forms an elongated trough in which multiple spools are supported. Although these wire spool caddies allow individual spools to be removed and replaced relatively easily independent of the other spools, the spools may become dislodged as the wire is being pulled therefrom. In addition, these wire spool caddies cannot easily be combined into an assembly for storing, displaying, using or transporting numerous spools.

SUMMARY OF THE INVENTION

These limitations in the prior art are overcome by providing a wire spool caddy for releasably holding at least one cylindrical spool having an outer diameter while a wire or the like is being unwound from the spool, the caddy comprising an elongated frame which includes first and second spaced apart ends, a plurality of generally parallel fixed rods which each extend between and are connected to the first and second ends, and at least one movable rod which is generally parallel to the fixed rods and which extends between and is movably connected to the first and second ends. At least two of the fixed rods are separated by a first distance which is less than the diameter of the spool to thereby form a bottom support for the spool. In addition, the movable rod is pivotable between a first position in which the movable rod is separated from an adjacent fixed rod by a second distance that is less than the diameter of the spool, and a second position in which the movable rod is separated from the adjacent fixed rod by a third distance which is greater than the diameter of the spool. Furthermore, the wire spool caddy preferably includes a spring or similar means for biasing the movable rod into its first position.

Thus, when the movable rod is in its first position the spool is securely retained between the movable and the fixed rods. In addition, when the movable rod is in its second position the spool may be removed or inserted between the movable rod and the adjacent fixed rod independently of any other spools which are held in the wire spool caddy. Furthermore, the frames of a number of wire spool caddies can be conveniently connected to form an assembly of wire spool caddies capable of storing, displaying, using or transporting numerous spools.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE PREFERRED EMBODIMENTS

Figure 1:
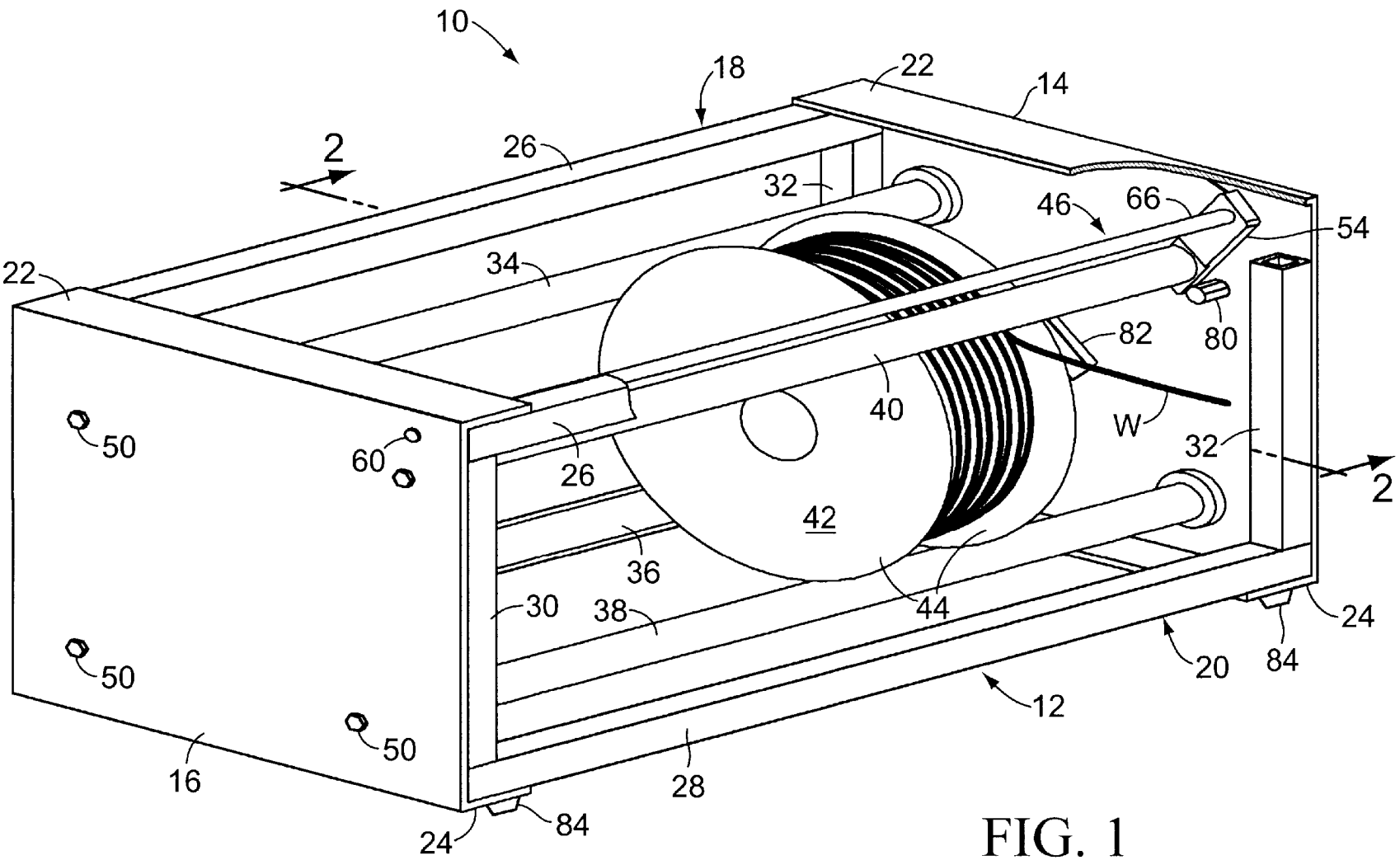
FIG. 1 is a perspective, partially broken view of the wire spool caddy of the present invention having a spool mounted therein.

Referring to FIG. 1, the wire spool caddy of the present invention, which is indicated generally by reference number 10, is shown to comprise an elongated frame 12 that includes first and second generally parallel end walls 14, 16 which are secured together by two preferably rectangular support members 18, 20. Each end wall 14, 16 ideally includes a top and a bottom transverse lip 22, 24, each of which overlaps a corresponding end of the support members 18, 20. In addition, each end wall 14,16 is preferably made from a durable sheet material, such as metal, that is bolted or welded to the support members 18, 20. Each support member 18, 20 comprises two generally parallel spreader beams 26, 28 which are connected together by a pair of parallel end beams 30, 32. The spreader beams 26, 28 and the end beams 30, 32 are preferably made from pieces of rectangular bar stock or the like which are secured together by suitable means, such as welding.

The wire spool caddy 10 also includes preferably three fixed rods 34, 36, 38 and at least one movable rod 40 for supporting a number of cylindrical spools 42 within the frame 12. Each spool 42 conventionally includes two parallel side walls 44 which are substantially circular in shape and define an outer diameter D of the spool, and which are connected by a transverse axis around which a wire, cable or the like W is wound. The fixed rods 34–38 extend between and are connected to the first and second end walls 14, 16. The movable rod 40 forms part of a pivot arm assembly 46 that extends between and is pivotally connected to the end walls 14, 16. The rods 34–40 are disposed generally parallel to each other and form an elongated framework which engages the periphery of the side walls 44 to secure the spool 42 within the wire spool caddy 10.

Figure 2:
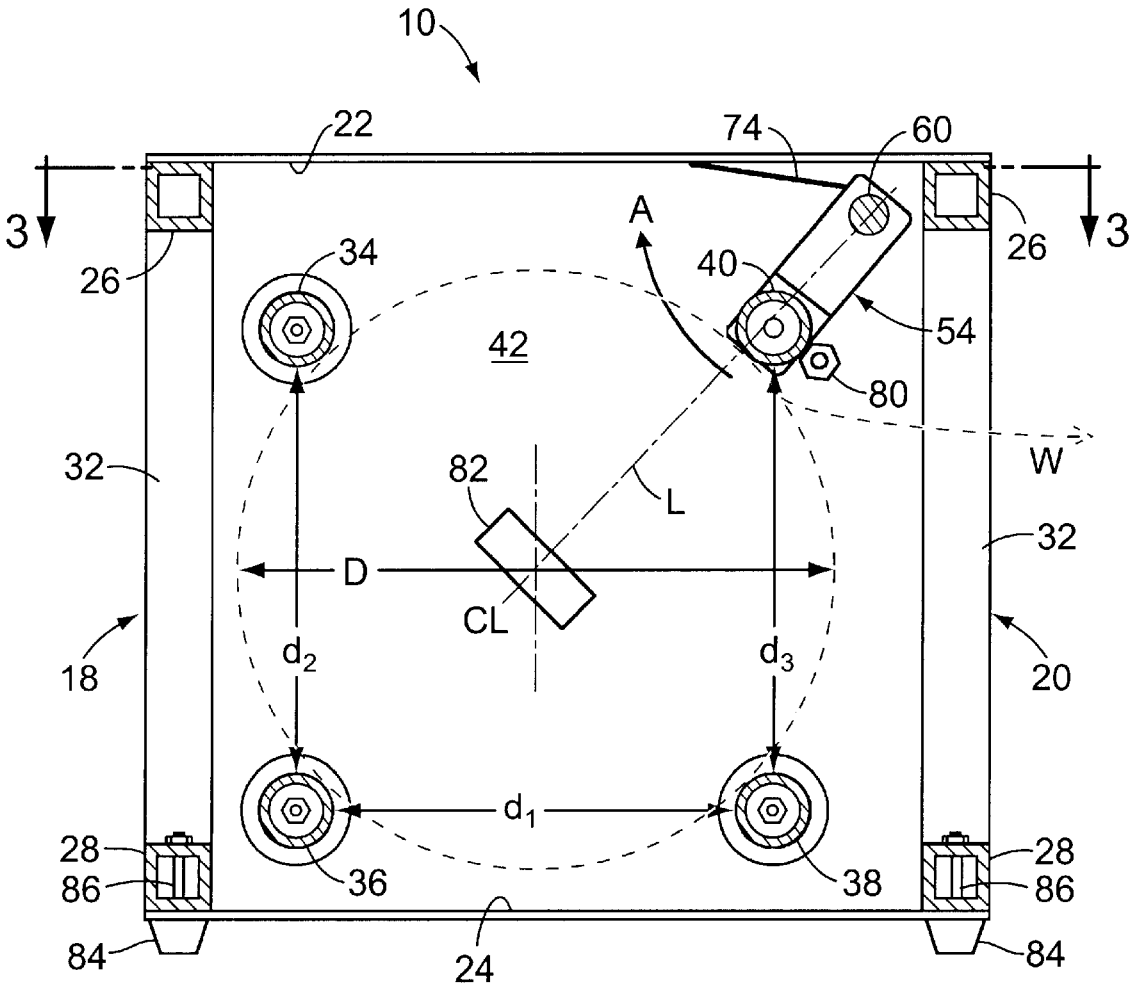
FIG. 2 is a cross sectional view of the wire spool caddy taken along line 2—2 of FIG. 1, showing the spool in phantom.

Referring to FIG. 2, the two lowermost fixed rods 36 and 38 are spaced apart a distance $d_1$ which is less than the diameter D of the spool 42. In this manner the fixed rods 36, 38 form a bottom support for the spool 42. Similarly, the fixed rods 34 and 36 are spaced apart a distance $d_2$ which is less than the diameter D to thereby form a rear support for the spool 42. Furthermore, the pivot arm assembly 46 normally maintains the movable rod 40 a distance $d_3$ from the lower fixed rod 38, and this distance $d_3$ is designed to be less than the diameter D so that the fixed rod 38 and the movable rod 40 will form a front support for the spool 42 which will maintain the spool within the wire spool caddy 10 as the wire W is being pulled from the spool (to the right as viewed in FIG. 2).

Figure 3:
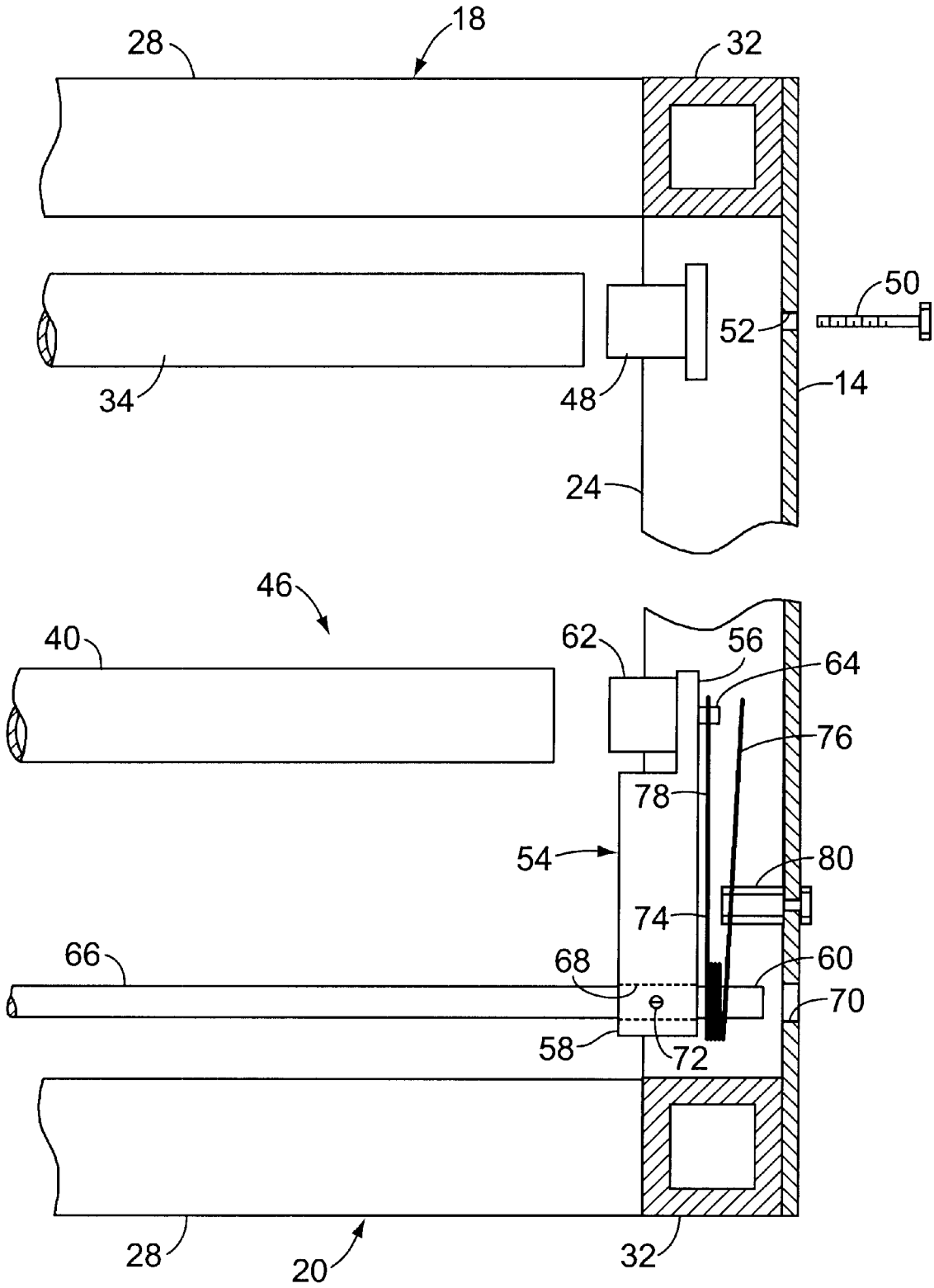
FIG. 3 is an enlarged, partially exploded view of the wire spool caddy taken along line 3—3 of FIG. 2.

The fixed rods 34–38 are preferably rotatably connected to the end walls 14, 16 to facilitate the rotation of the spool 42 as the wire is being pulled therefrom. As shown in FIG. 3, each end of each fixed rod, such as fixed rod 34, is hollow and is slidably received over a bushing 48 that in turn is connected to a corresponding end wall 14, 16. The fixed rods 34–38 are ideally made of hollow, preferably metal tube stock, and the bushings 48 are optimally constructed of a suitable non-metallic material, such as Nylon®. In addition, each bushing 48 is preferably secured to its corresponding end wall 14, 16 using a bolt 50, which passes through a corresponding hole 52 in the end wall and is ideally received in a threaded hole that is formed in the bushing. Therefore, during assembly of the wire spool caddy 10, the bushings 48 are first inserted into the ends of the fixed rods 34–38 and the fixed rods are then connected to the frame 12 by bolting the bushings to the end walls 14, 16.

In an alternative of the invention not illustrated in the drawings, the frame 12 of the wire spool caddy does not include the support members 18, 20. Rather, the end walls 14,16 are held together by the fixed rods 34–38. In addition, the ends of the fixed rods 34–38 are secured to the end walls 14, 16 using suitable means to maintain the end walls spaced apart a fixed distance. This construction of the wire spool caddy 10, while not as robust as the embodiment discussed above, is lighter and less costly to produce.

In accordance with the present invention, the pivot arm assembly 46 permits the movable rod 40 to swing away from one or more of the fixed rods so that the spool 42 can be removed from or inserted into the wire spool caddy 10. Referring again to FIG. 2, in the preferred embodiment of the invention the movable rod 40 is pivoted in the direction of the arrow A into a displaced position (not shown) in which the movable rod is spaced apart from the fixed rod 38 by a distance which is greater than the diameter D of the spool 42. This permits the spool 42 to be removed or inserted through the front of the wire spool caddy 10 between the fixed rod 38 and the movable rod 40. When the movable rod 40 is released, it will return to its normal position shown in the Figures to secure the spool 42 against the fixed rods 34–38.

Referring again to FIGS. 1–3, the pivot arm assembly 46 comprises two generally parallel brackets 54 (only one of which is visible), each of which includes a first end 56 to which a corresponding end of the movable rod 40 is connected and a second end 58 which is rotatably connected to a corresponding end wall 14, 16 with a pivot pin 60. The movable rod 40 is preferably similar in construction to the fixed rods 34–38 and is ideally rotatably connected to the brackets 54 with a pair of ball bearing assemblies 62, each of which is optimally press fit into a corresponding end of the movable rod and secured to the bracket with a spring pin 64 that passes through corresponding holes in the ball bearing assembly and the first end 56. Moreover, in the preferred embodiment of the invention the pivot pins 60 are the opposite ends of a common pivot bar 66 which extends between the end walls 14,16 generally parallel to the fixed and movable rods 34–40. Each end of the pivot bar 66 extends through a hole 68 in the second end 58 of the bracket 54 and is rotatably supported in an aperture 70 that is formed in a corresponding end wall 14, 16. In addition, the pivot bar 66 is optimally secured to each bracket 54 by a set screw 72. In this manner, each bracket 54 is non-rotationally connected to the pivot bar 66, and the movable rod 40 is therefore pivotable about the pivot bar. When assembled as just described, the pivot bar 66 imparts lateral stability to the pivot arm assembly 46 and also provides a fulcrum about which the movable rod 40 can be grasped and pivoted.

The pivot arm assembly 46 also preferably includes a return biasing member for urging the movable rod 40 into its normal position against or adjacent the spool 42. In the embodiment of the invention shown in the Figures, the return biasing member comprises at least one and preferably two torsion springs 74, each of which is operatively engaged between the frame 12 and a corresponding bracket 54. Each torsion spring includes a coiled central portion which is positioned over the pivot pin 60, a first arm 76 which is positioned against the top lip 22 of a corresponding end wall 14, 16, and a second arm 78 which is positioned against the spring pin 64 that is connected to the first end 56 of the bracket 54. Of course, the return biasing member could include other, similarly functioning devices, including a leaf spring or a compression spring, which is connected between the frame 12 and the bracket 54 or the movable rod 40.

The wire spool caddy 10 preferably also includes a swing stop 80 to limit the downward movement of the pivot arm 46 in the absence of a spool 42. As shown in FIG. 3, the swing stop 80 is a cylindrical member which is bolted or secured by other suitable means to the end wall 14. The swing stop 80 is positioned such that the bracket 54 will preferably engage the swing stop when the movable rod 40 rests against the spool 42. Alternatively, the swing stop can be located slightly below this position so that the torsion springs 74 will bias the movable rod 40 tightly against the spool 42 in order to maintain the spool securely against the fixed rods 34–38 as the wire is being unwound from the spool.

As shown in FIG. 2, the brackets 54 are oriented on the end walls 14, 16 such that, when the spool 42 is mounted in the wire spool caddy 10, the movable rod 40 will be situated roughly between the pivot bar 66 and the centerline CL of the spool. Thus, when the wire W is pulled from the spool 42 (to the right as shown in FIG. 2), the resulting lateral force which is imparted on the spool 42 will not generate a vertical force on the movable rod 40 that is sufficient to overcome the return force of the torsion springs 74. Consequently, the movable rod 40 will prevent the spool 42 from being pulled out of the wire spool caddy 10 when the wire W is being pulled. In the preferred embodiment of the invention, the movable rod 40 is disposed at an angle of between plus or minus twenty degrees as measured from the pivot pin 60 relative to a line L which extends between the pivot pin and the centerline CL of the spool 42.

The wire spool caddy 10 ideally also comprises two spacer blocks 82 to maintain the spools 42 a desired distance from the end walls 14, 16. Each spacer block 82 is preferably a simple rectangular member that is welded to a corresponding end wall 14, 16 in a position which is roughly aligned with the center of the spool 42. In addition, the spacer blocks 82 are sufficiently wide to prevent to spools from engaging the bushings 48 and brackets 54 to ensure that the spools do not interfere with the rotation of the fixed rods 34–38 or the operation of the pivot arm assembly 46.

The wire spool caddy 10 may also be provided with a number of feet 84 for supporting the frame 12 on a support surface. The feet 84 are ideally connected to the bottom lips 24 of the end walls 14, 16 or to the bottom spreader beams 28 of the support members 18, 20 using bolts 86. In addition, the feet 84 are preferably made of a resilient material, such as rubber, to increase the friction between the frame and the supporting surface, which will help maintain the wire spool caddy 10 in position as the wire W is being pulled from the spool 42. If desired, the feet 84 may be replaced with casters to allow the wire spool caddy 10 to be wheeled to a desired location.

In operation, a spool 42 is loaded into the wire spool caddy 10 by first manually pivoting the movable rod 40 upwardly until the distance between the movable rod and the fixed rod 38 is greater than the diameter D of the spool. The spool 42 is then positioned onto the lower fixed rods 36, 38 and against the upper fixed rod 34. The movable rod 40 is then released, whereupon it will retract to its normal position against or adjacent the spool 42. Alternatively, the spool 42 can be loaded into the wire spool caddy 10 by simply pushing the spool through the space between the fixed rod 38 and the movable rod 40 until the spool snaps in place between the fixed and movable rods 34–40. The fixed and movable rods 34–40 will then maintain the spool 42 firmly in position as the wire is being pulled therefrom. In order to remove the spool from the wire spool caddy 10, the movable rod 40 is manually pivoted upwardly until the distance between the movable rod and the fixed rod 38 is greater than the diameter D of the spool. The spool 42 can then simply be removed from the wire spool caddy 10.

Figure 4:
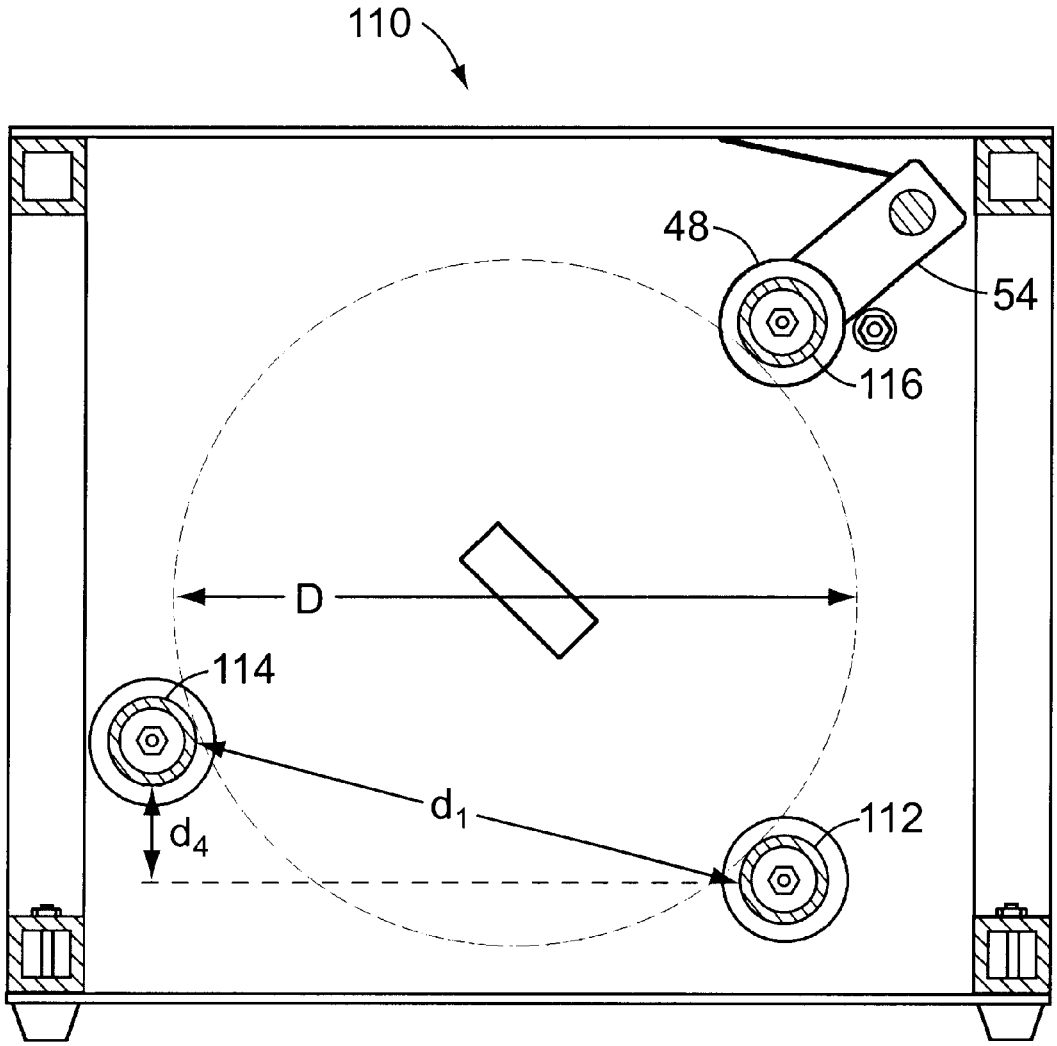
FIG. 4 is a cross sectional view of another embodiment of a wire spool caddy of the present invention.

An alternative embodiment of the present invention is illustrated in FIG. 4. The wire spool caddy of this embodiment, which is indicated generally by reference number 110, is shown to comprise only two fixed rods 112, 114 and a single movable rod 116. As in the previous embodiment, the fixed rods 112, 114 are spaced apart a distance $d_1$ which is less than the diameter D of the spool 42. Thus, the fixed rods 112, 114 will provide a bottom support for the spool 42. In addition, however, the rear fixed rod 114 is located a distance $d_4$ above the front fixed rod 112. In this manner, the fixed rod 114 will provide a rear support for the spool 42 without the need for a third fixed rod. Furthermore, the movable rod 116 of this embodiment may be connected to each bracket 54 with a bushing 48 in a manner similar to that discussed above for connecting the fixed rods 34–38 to the end walls 14, 16. The wire spool caddy 110 is similar in all other respects to the wire spool caddy 10 discussed above.

Figure 5:
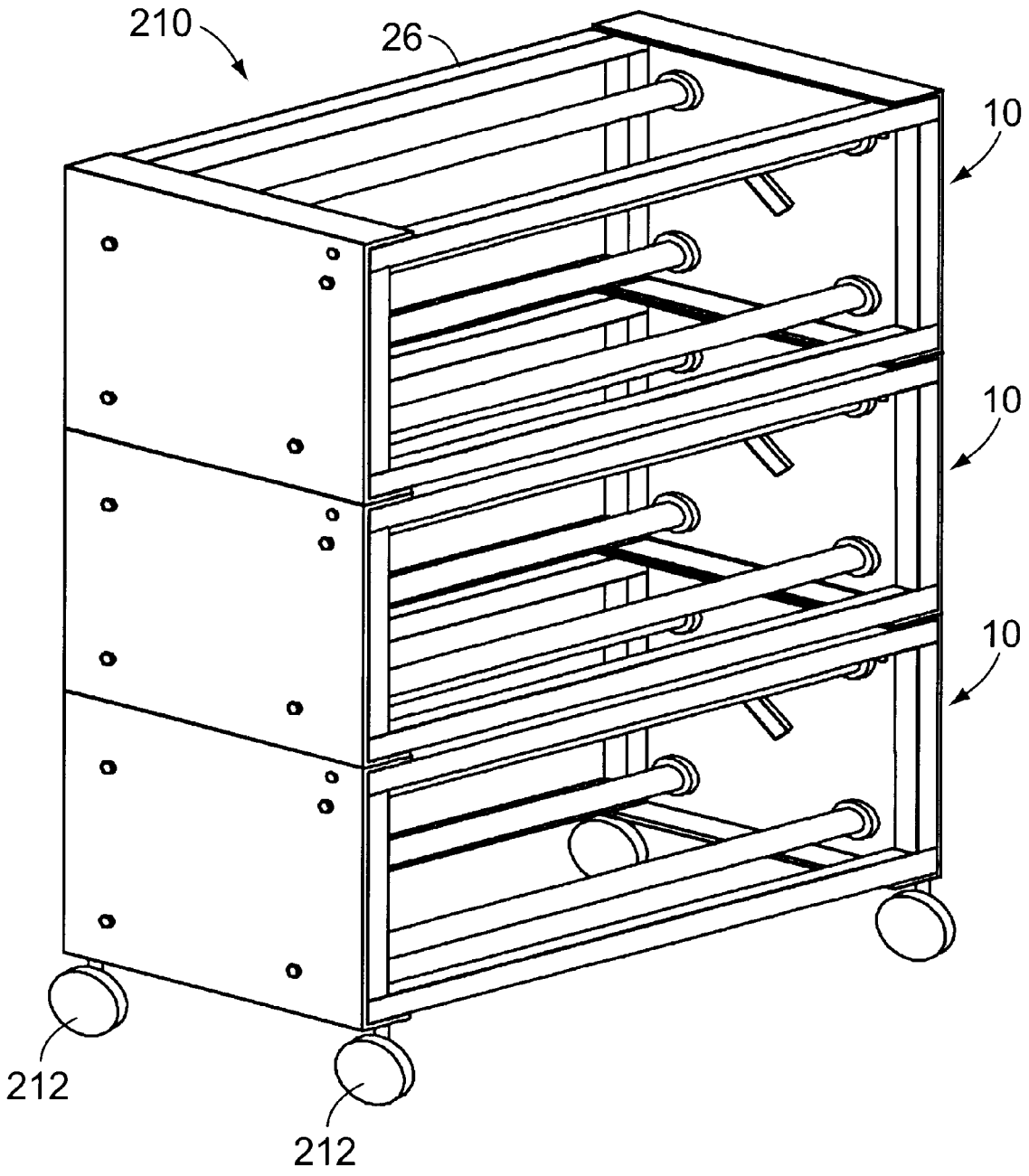
FIG. 5 is a perspective view of an assembly of three wire spool caddies of FIG. 1.

FIG. 5 illustrates how a number of wire spool caddies, such as wire spool caddy 10, may be connected in an assembly 210 to facilitate the storage, display, use or transport of numerous spools. Each wire spool caddy 10 is connected to the one below using bolts inserted through corresponding holes, such as the holes which were used to mount the feet 88 to the bottom of the wire spool caddy 10. In addition, the lowermost wire spool caddy 10 is preferably provided with casters 212 to enable the assembly 210 to be easily rolled from location to location. In this regard, the top spreader beam 26 of the top wire spool caddy 10 may be used as a handle for the assembly 210.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

I claim:

1. A wire spool caddy for releasably holding at least one cylindrical spool having an outer diameter while a wire or the like is being unwound from the spool, the caddy comprising:

an elongated frame which includes first and second spaced apart ends;

a plurality of generally parallel fixed rods which each extend between and are connected to the first and second ends; and at least one movable rod which is generally parallel to the fixed rods and which extends between and is pivotably connected to the first and second ends;

wherein at least two of the fixed rods are separated by a first distance which is less than the diameter of the spool to thereby form a bottom support for the spool; and wherein the movable rod is pivotable between a first position in which the movable rod is separated from an adjacent fixed rod by a second distance that is less than the diameter of the spool, and a second position in which the movable rod is separated from the adjacent fixed rod by a third distance which is greater than the diameter of the spool;

whereby when the movable rod is in its first position the spool is retained between the movable rod and the fixed rods, and when the movable rod is in its second position the spool may be removed or inserted between the movable rod and the adjacent fixed rod.

2. The wire spool caddy of claim 1, further comprising:

a first bracket which is rotatably connected to the first end at a first point; and a second bracket which is rotatably connected to the second end at a second point;

wherein the movable rod extends between and is connected to the first and second brackets.

3. The wire spool caddy of claim 2, wherein the movable rod is disposed generally between a centerline of the spool and a line connecting the first and second points.

4. The wire spool caddy of claim 2, further comprising:

a pivot bar which includes a first pivot bar end that is rotatably connected to the first end of the frame at the first point and a second pivot bar end that is rotatably connected to the second end of the frame at the second point;

wherein each of the first and second brackets is secured to a respective one of the first and second pivot bar ends.

5. The wire spool caddy of claim 4, wherein each of the first and second pivot bar ends is rotatably received within a hole in a corresponding end of the frame.

6. The wire spool caddy of claim 1, further comprising means for biasing the movable rod into its first position.

7. The wire spool caddy of claim 6, wherein the biasing means comprises at least one torsion spring which is connected between the movable rod and the frame.

8. The wire spool caddy of claim 1, wherein the movable rod is pivotable about a first line which extends between the first and second ends generally parallel to the fixed rods.

9. The wire spool caddy of claim 8, wherein when the movable rod is in its first position, the movable rod is disposed at an angle of less than about twenty degrees relative to a second line which extends between the first line and the centerline of the spool.

10. The wire spool caddy of claim 9, wherein the movable rod is disposed generally between the first line and the centerline of the spool.

11. A wire spool caddy for releasably holding at least one cylindrical spool of wire or the like having an outer diameter, the caddy comprising:

an frame which includes first and second spaced apart ends;

a plurality of generally parallel fixed rods which each extend between and are connected to the first and second ends;

a first bracket which is rotatably connected to the first end at a first point;

a second bracket which is rotatably connected to the second end at a second point generally opposite the first point; and at least one movable rod which is generally parallel to the fixed rods and which extends between and is connected to the first and second brackets;

wherein at least two of the fixed rods are separated by a first distance which is less than the diameter of the spool to thereby form a bottom support for the spool; and wherein the movable rod is pivotable between a first position in which the movable rod is separated from an adjacent fixed rod by a second distance that is less than the diameter of the spool, and a second position in which the movable rod is separated from the adjacent fixed rod by a third distance which is greater than the diameter of the spool;

whereby when the movable rod is in its first position the spool is retained between the movable rod and the fixed rods, and when the movable rod is in its second position the spool may be removed or inserted between the movable rod and the adjacent fixed rod.

12. The wire spool caddy of claim 11, wherein the movable rod is disposed generally between a centerline of the spool and a line connecting the first and second points.

13. The wire spool caddy of claim 11, further comprising:

a pivot bar which includes a first pivot bar end that is rotatably connected to the first end of the frame at the first point and a second pivot bar end that is rotatably connected to the second end of the frame at the second point;

wherein each of the first and second brackets is secured to a respective one of the first and second pivot bar ends.

14. The wire spool caddy of claim 13, to wherein each of the first and second pivot bar ends is rotatably received within a hole in a corresponding end of the frame.

15. The wire spool caddy of claim 11, further comprising means for biasing the movable rod into its first position.

16. The wire spool caddy of claim 15, wherein the biasing means comprises at least one torsion spring which is connected between the movable rod and the frame.

17. The wire spool caddy of claim 11, wherein when the movable rod is in its first position, the movable rod is disposed at an angle of less than about twenty degrees relative to a first line which extends between the centerline of the spool and a second line connecting the first and second points.

18. The wire spool caddy of claim 17, wherein the movable rod is disposed generally between the centerline of the spool and the second line.

* * * * *